US007229294B1

(12) United States Patent
Patel et al.

(10) Patent No.: US 7,229,294 B1
(45) Date of Patent: Jun. 12, 2007

(54) SUPPLYING POWER

(75) Inventors: Kanu D. Patel, North Chelmsford, MA (US); Phillip J. Roux, Sutton, MA (US); Keith C. Johnson, Medway, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 11/529,911

(22) Filed: Sep. 29, 2006

(51) Int. Cl.
*H01R 12/00* (2006.01)

(52) U.S. Cl. ..... 439/76.1; 439/638; 439/956

(58) Field of Classification Search ..... 439/76.1, 439/79, 502, 638, 956; 363/142–146
See application file for complete search history.

(56) References Cited

U.S. PATENT DOCUMENTS 3,549,861 A * 12/1970 Trachtenberg et al. ..... 219/441
6,358,096 B1 * 3/2002 Beckman ..... 439/638
6,638,113 B2 * 10/2003 Kajiwara et al. ..... 439/651
7,140,922 B2 * 11/2006 Luu et al. ..... 439/651

* cited by examiner

*Primary Examiner*—Khiem Nguyen
(74) *Attorney, Agent, or Firm*—Krishnendu Gupta; Jason A. Reyes

(57) ABSTRACT

Apparatus for use in supplying power includes an input connector and first and second output connectors. The input connector has first and second sets of pins. The first set is dedicated to receiving DC power, and the second set is dedicated to receiving AC power. The first output connector has third and fourth sets of pins. The third set is dedicated to outputting DC power based on input from the first set of pins, and the fourth set is dedicated to outputting AC power based on input from the second set of pins. The second output connector has fifth and sixth sets of pins. The fifth set is dedicated to outputting DC power based on input from the first set of pins, and the sixth set is dedicated to outputting AC power based on input from the second set of pins.

16 Claims, 6 Drawing Sheets

SUPPLYING POWER

FIELD OF THE INVENTION

The present invention relates generally to supplying power.

BACKGROUND OF THE INVENTION

Complex electronic equipment typically needs a power source. This power source is typically supplied by either an alternating current (AC) power supply or a direct current (DC) power supply. Yet, most electronics cannot handle switching from AC to a DC power source, or vice versa, without damage. The damage occurs because the electronic system is not configured to receive both AC and DC power. Further, such systems may not have circuitry to detect and safeguard against connection of power source that would cause damage.

As a result, reconfiguration of an AC system to take DC power, or vice versa, can present numerous challenges. Different connection cables are used for AC and DC to help avoid confusion as to the power source the system is configured to use. As a result, system reconfiguration from one power source to another requires the use of different connectors. Use of different connectors then necessitates replacing certain pieces upon which the connectors were mounted, such as the chassis.

These challenges present complexities for manufacturers of electronic equipment. Often, the same device is manufactured in one case to use AC power and in other cases to use DC power. The use of different connectors leads to higher costs but avoids incorrectly connecting an AC supply to a DC system and destroying the electronic equipment.

An example of this is when a data storage system can be used in both an AC and a DC environment. A data storage system in a telecommunication setting can run on DC power provided therein. Conversely, the same type of data storage system can also be used in a hospital setting where it can run on AC power. While these systems typically store different types of data, they may be almost identical short of either having an AC or DC power supply and associated AC or DC connector. Currently, each system must be customized to run on either AC or DC power and results in the aforementioned complexities.

High Availability systems are typically constructed such that single points of failure are avoided. One means for avoiding single points of failure is to provide redundant components. For example, two processors may be provided such that if one fails, the other can assume the role of the first processor as well as its own. However, redundancy increases cost and can be an inefficient use of resources.

Furthermore, in Highly Available systems, the failure of a component in the system can cause redundant parts of the system to fail as well. Special care must be taken to ensure that component failures do not cause cascading failures.

SUMMARY OF THE INVENTION

Apparatus for use in supplying power includes an input connector and first and second output connectors. The input connector has first and second sets of pins. The first set is dedicated to receiving DC power, and the second set is dedicated to receiving AC power. The first output connector has third and fourth sets of pins. The third set is dedicated to outputting DC power based on input from the first set of pins, and the fourth set is dedicated to outputting AC power based on input from the second set of pins. The second output connector has fifth and sixth sets of pins. The fifth set is dedicated to outputting DC power based on input from the first set of pins, and the sixth set is dedicated to outputting AC power based on input from the second set of pins.

One or more embodiments of the invention may provide one or more of the following advantages.

A system having an input power connector may be switched from using AC power to using DC power, or vice versa, without changing the input power connector, by replacing an external power cord and an internal power supply.

Other advantages and features will become apparent from the following description, including the drawings, and from the claims.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION

Techniques are described below for accommodating different dual power input sources (AC and DC) for a data storage system. The techniques allow simplification and reduce cost by helping to avoid the need to build different chassis depending on the type of power source available at an installation location. As described below, a power board can provide both AC and DC input power to a power supply using an output connector. The output connector can provide AC and DC input power and signals to power supplies. In at least some implementations, the power board has electromagnetic interference (EMI) filtering on both AC and DC input power, four output connectors, two switches which control signals to backup the data storage system's cache system, LEDs for DC power status, and two input connectors configured customized to use for AC and DC power. Each input connector's configuration corresponds to N+1 redundancy, with each input connector providing the power (AC or DC) to two power supplies.

The power board is configured so that either input connector alone can provide full power to the data storage system using two power supplies. In at least one implementation, two different type of power supplies may be used in the system, which are AC to DC (90 to 265 Vac AC input, DC output), and DC to DC (−36 to −72 VDC DC input, DC output).

The techniques allow a single mechanical chassis to use either power supply (AC/DC or DC/DC). In particular, the power board has separate AC and DC power paths so that a power supply does not cause damage or a fire if the wrong power supply is installed for the input power (e.g., an AC power supply is installed for DC input power).

Figure 1:
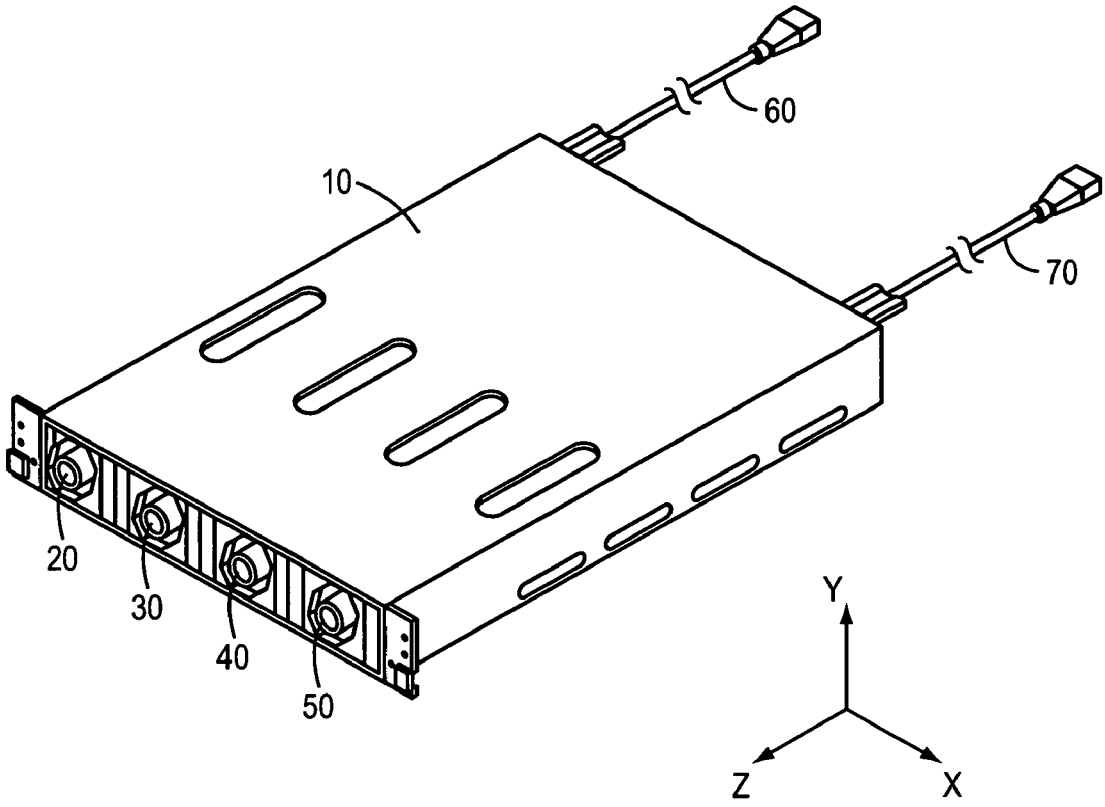
FIGS. 1-2 are perspective views of a data storage system.

FIG. 1 illustrates an example of a storage system 10 in which the techniques may be employed. System 10 is rack mountable, includes a first internal power supply having rear positioned fans 20 and 30, and includes a second internal power supply having rear positioned fans 40 and 50. A first source of external power is connected to the front side of system 10 by a first power cable 60 and a second source of external power is connected to the front side system 10 by a second power cable 70.

Figure 2:
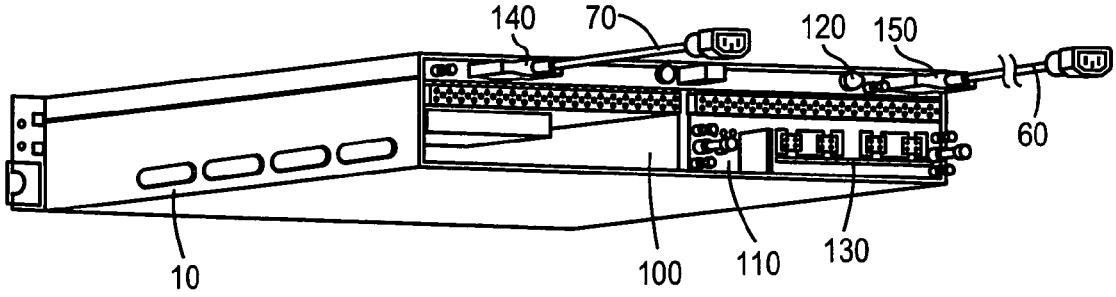

FIG. 2 illustrates that cables 60 and 70 connect to a power board component 120 that is disposed above storage processor bays 100 and 110, with bay 110 being loaded with storage processor 130. The cables 60 and 70 are configured to carry external power to the system. Each cable has a standard connector, 140 and 150 respectively, and each cable 60 and 70 may be configured to carry either AC or DC power. The connectors 140 and 150 are of a standard design matched to fit into the power board component. Each of bays 100 and 110 is configured to receive a storage processor; as shown, storage processor 130 has been inserted into bay 110.

Figure 3:
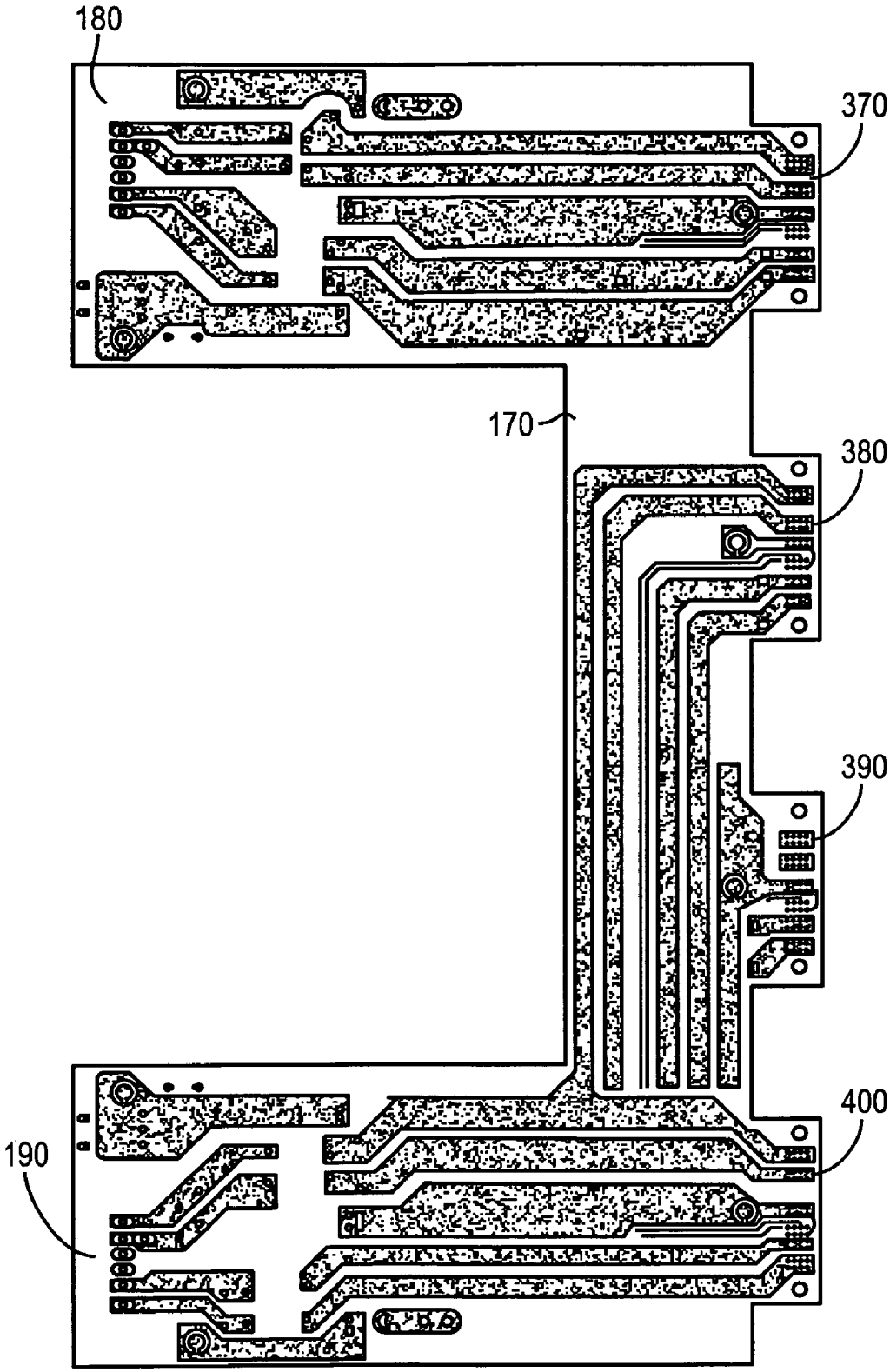
FIG. 3 is a top view of a portion of a power board component of the data storage system of FIGS. 1-2.
Figure 4A:
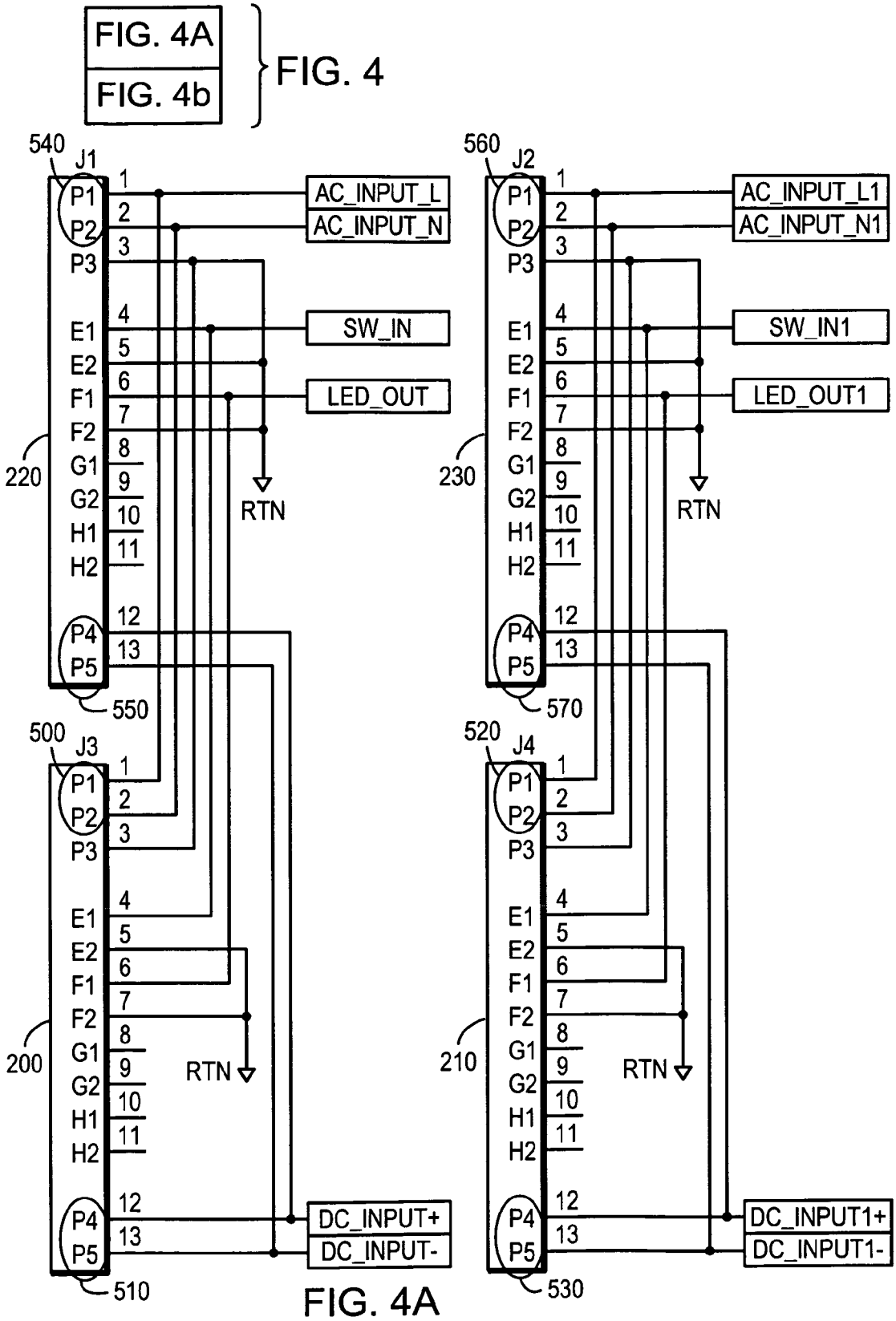
FIG. 4 is a schematic view of aspects of the power board component of the data storage system of FIGS. 1-2.
Figure 4B:
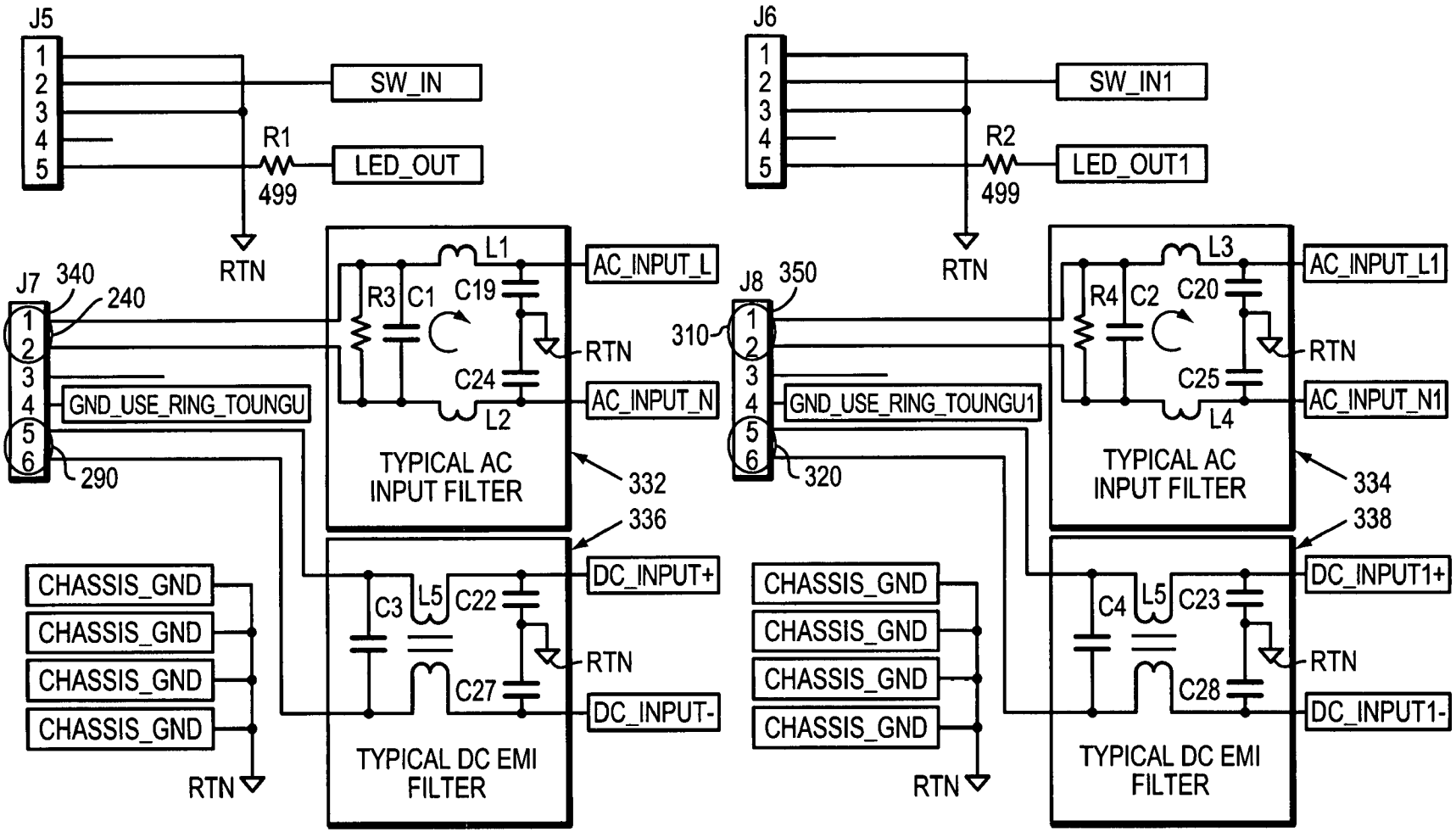
Figure 5:
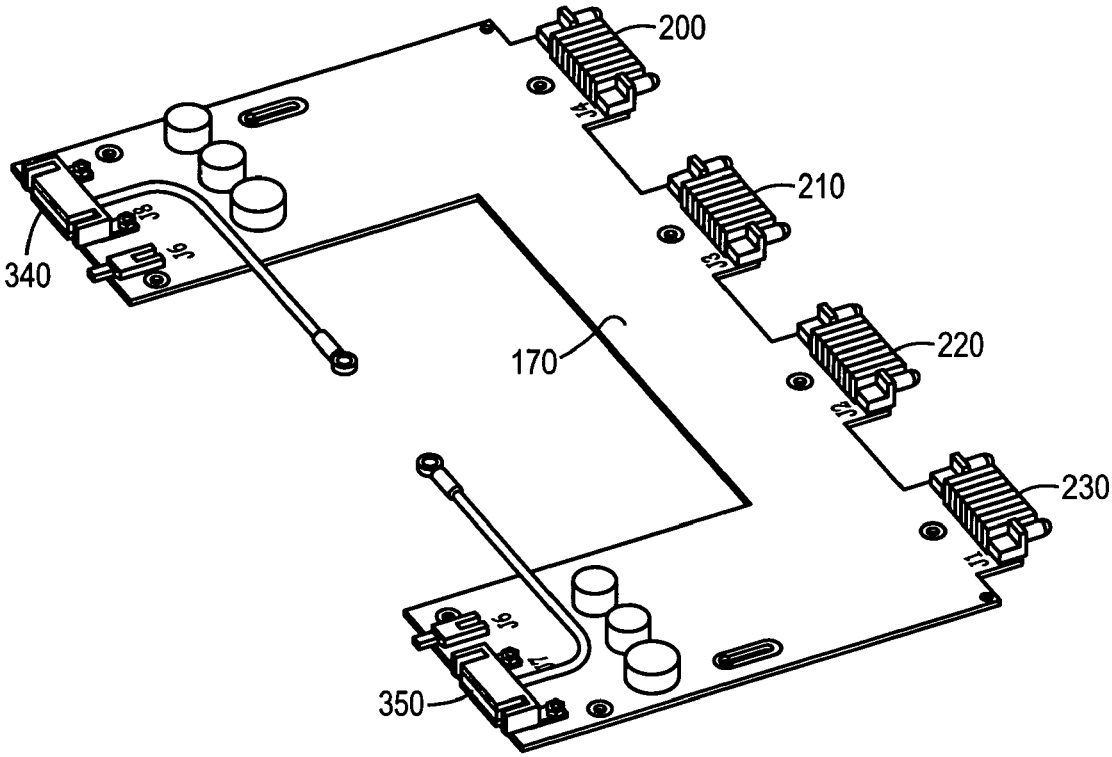
FIG. 5 is a perspective view of portions of the power board component of the data storage system of FIGS. 1-2.

FIGS. 3 and 5 illustrate a sample embodiment of physical aspects of power board component 120, particularly printed circuit board 170. FIG. 4 schematically illustrates circuitry of the sample embodiment. Input power connector 340 (FIG. 5) mounted at board location 180 (FIG. 3) is configured to receive connector 140 of cable 70 (FIG. 2). Input power connector 350 (FIG. 5) mounted at board location 190 (FIG. 3) is configured to receive connector 150 of cable 60 (FIG. 2). Power supply connectors 220, 230 connect to the first power supply (having fans 20, 30 in FIG. 1) and power supply connectors 200, 210 connect to the second power supply (having fans 40, 50 in FIG. 1).

Input power connector 340 connects an input DC line to power supply connectors 200 and 220 (FIG. 5) at board locations 370 and 390 (FIG. 3). As described below, input power connector 340 also connects an AC input line to power supply connectors 200 and 220 at board locations 370 and 390. Similarly, input power connector 350 connects another input DC line to power supply connectors 210 and 230 (FIG. 5) at board locations 380 and 400, and also connects another AC input line to power supply connectors 210 and 230 at board locations 380 and 400.

Board 170 links the first and second power supplies with cables 60, 70 to deliver external power to the first and second power supplies. As referenced above, board 170 has locations 180, 190 at which input power connectors 340, 350 are mounted to receive cables 70 and 60, and board 170 also has locations 370, 380, 390, 400 at which power supply connectors 200, 210, 220, 230 are mounted to connect to the power supplies. In particular, locations 370, 380 help deliver external power to the second power supply and locations 390, 400 help deliver external power to the first power supply. Board 170 has circuitry (e.g., conductive traces) configured so that external power from location 190 is delivered to locations 380, 400, and so that external power from location 180 is delivered to locations 370, 390. Thus, both first and second power supplies can be driven by external power from either or both locations 180, 190. For example, if external power is available only from location 180 (e.g., due to a failure), both first and second power supplies can be driven by external power from location 190.

FIG. 4 schematically illustrates aspects of board 170. In particular, FIG. 4 illustrates that input power connector 340 (mounted at location 180 as shown in FIG. 3) has a first set of pins 240 used exclusively for helping to deliver AC external power to power supply connectors 200, 220, and has a second set of pins 290 used exclusively for helping to deliver DC external power to power supply connectors 200, 220. Similarly, input power connector 350 (mounted at location 190 as shown in FIG. 3) has a third set of pins 310 used exclusively for helping to deliver AC external power to power supply connectors 210, 230, and has a fourth set of pins 320 used exclusively for helping to deliver DC external power to power supply connectors 210, 230. This use of pins allows the same input power connector to be used with DC external power or AC external power, as long as correspondingly configured power cables are used. In particular, for example, as long as input power connector 340 is connected to a power cable that delivers only AC external power to the first set of pins and/or delivers only DC external power to the second set of pins, power is routed properly.

Similarly, each of power supply connectors 200, 210, 220, 230, which are disposed at respective locations 370, 380, 390, 400 as shown in FIG. 3, has a set of pins dedicated exclusively to DC power, and has another set of pins dedicated exclusively to AC power, so that the same power supply connectors can be used for a DC power supply or an AC power supply. In particular, connector 200 has a first set of pins 500 dedicated exclusively to AC power and has a second set of pins 510, dedicated exclusively to DC power. Similarly, connector 210 has a first set of pins 520 dedicated exclusively to AC power and has a second set of pins 530 dedicated exclusively to DC power; connector 220 has a first set of pins 540 dedicated exclusively to AC power and has a second set of pins 550 dedicated exclusively to DC power; and connector 230 has a first set of pins 560 dedicated exclusively to AC power and has a second set of pins 570 dedicated exclusively to DC power.

In at least some implementations as shown by example in FIG. 4, one or more sets of filtering circuitry may be provided between one or more input power connectors and one or more power supply connectors. FIG. 4 illustrates first filtering circuitry 332 provided to filter electromagnetic interference. For AC power, circuitry 332 is connected between set 240 and sets 500, 540, and circuitry 334 is connected between set 310 and sets 520, 560. For DC power, circuitry 336 is connected between set 290 and sets 510, 550, and circuitry 338 is connected between set 320 and sets 530, 570.

The techniques allow a standardized AC/DC chassis and cabling apparatus to be provided, e.g., for a data storage system, that is safety approved and/or certified and that has a low profile. Cost savings are achieved due to the standardization, particularly in view of the fact that DC-based data storage systems may account for only a small minority (e.g., 10%, primarily in telecommunications applications) total production of a particular class or type of data storage system. In addition, the techniques facilitate inventory control since AC units can be easily converted and shipped to DC customers, or vice versa, by swapping out AC for DC power supplies or vice versa.

The techniques also provide an added benefit that they help protect against incorrect connection of AC power to a DC chassis, and vice versa. In particular, by using the different sets of AC and DC pins as described above, board 170 safeguards against incorrectly connecting the incorrect power supply or cable.

In the particular implementation, a standardized 5 pin connector is used as connector 340 and uses the first/last two pins as the line/neutral connection for AC power, a middle pin for ground, and the last/first two pins for the positive/negative for the DC power. Accordingly the connector forces the AC to be on one side and the DC on the other side (right or left). The shape of the connector provides a physical and mechanical barrier to incorrectly connecting AC and DC power.

As described, on board 170 the connector is connected to the appropriate circuitry to map an AC source of external power to an AC power supply and a DC source of external power to a DC power supply. Through this circuitry, if AC power is supplied to a DC unit, or if DC power is supplied to an AC unit, no power is connected.

In at least one sample embodiment, one or more of the following standard components may be used, with reference to FIG. 4. Each of resisters R1/R2 may have a resistance of 499 Ohms and carry a load of 0.25 W. Each of power supply connectors 200, 210, 220, 230 may be part number of 51915-054LF available from FCI. Each of input power connectors 340, 350 may be part number PLA05M400A1/AA-171.1 available from Positronic Industries.

The present invention is not to be limited in scope by the specific embodiments described herein. Indeed, various modifications of the present invention, in addition to those described herein, will be apparent to those of ordinary skill in the art from the foregoing description and accompanying drawings. Thus, such modifications are intended to fall within the scope of the invention. Further, although aspects of the present invention have been described herein in the context of a particular implementation in a particular environment for a particular purpose, those of ordinary skill in the art will recognize that its usefulness is not limited thereto and that the present invention can be beneficially implemented in any number of environments for any number of purposes. For example, though the invention has been described in terms of a storage system, it is clear that the invention can be employed in any type of system wherein a flexible power supply system would be useful—for example, computer systems.

We claim:

1. Apparatus for use in supplying power, comprising:

a power board comprising a first input connector comprising a first set of pins and a second set of pins;

a second input connector comprising a third set of pins and a fourth set of pins;

a first output connector comprising a fifth set of pins and a sixth set of pins;

a second output connector comprising a seventh set of pins and an eighth set of pins;

a third output connector comprising a ninth set of pins and a tenth set of pins; and a fourth output connector comprising a eleventh set of pins and a twelfth set of pins;

wherein the first and third sets of pins are configured to receive AC power and the second and fourth sets of pins are configured to receive DC power;

wherein the fifth, seventh, ninth, and eleventh sets of pins are configured to output AC power and the sixth, eighth, tenth, and twelfth sets of pins are configured to output DC power;

wherein the power board drives the fifth and seventh ninth sets of pins based on the input from the first set of pins;

wherein the power board drives the sixth and eighth tenth sets of pins based on the input from the second set of pins;

wherein the power board drives the ninth seventh and eleventh sets of pins based on the input from the third set of pins; and wherein the power board drives the tenth eighth and twelfth sets of pins based on the input from the fourth set of pins.

2. Apparatus for use in supplying power, comprising:

an input connector having first and second sets of pins, the first set being dedicated to receiving DC power, the second set being dedicated to receiving AC power;

a first output connector having third and fourth sets of pins, the third set being dedicated to outputting DC power based on input from the first set of pins, the fourth set being dedicated to outputting AC power based on input from the second set of pins; and a second output connector having fifth and sixth sets of pins, the fifth set being dedicated to outputting DC power based on input from the first set of pins, the sixth set being dedicated to outputting AC power based on input from the second set of pins.

3. The apparatus of claim 1 further comprising a first power cable comprising a first standardized connector; and a second power cable comprising second standardized connector;

wherein the first input connector is configured to receive the first standardized connector and the second input connector is configured to receive the second standardized connector.

4. The apparatus of claim 3 wherein the first and the second power cables supply DC power to the power board.

5. The apparatus of claim 3 wherein the first and second power cables supply AC power to the power board.

6. The apparatus of claim 3 wherein the first cable supplies AC power to the power board and the second cable supplies DC power to the power board.

7. The apparatus of claim 1 further comprising:

a first power supply; and a second power supply;

wherein the first power supply is configured to attach to at least one of the first and second output connectors;

wherein the second power supply is configured to attach to at least one of the third and fourth input connectors.

8. The apparatus of claim 7 wherein the first and second power supplies are of the AC type.

9. The apparatus of claim 7 wherein the first and second power supplies are of the DC type.

10. The apparatus of claim 7 wherein the first power supply is of the AC type and the second power supply is of the DC type.

11. The apparatus of claim 1 further comprising a first power supply;

a second power supply;

a first input cable with a first standardized connector; and a second input cable with a second standardized connector;

wherein the first input connector is configured to receive the first standardized connector;

wherein the second input connector is configured to receive the second standardized connector;

wherein the first power supply is configured to attach to at least one of the first and second output connectors;

wherein the second power supply is configured to attach to at least one of the third and fourth input connectors.

12. The apparatus of claim 11 wherein the first and second power cables supply AC power and wherein the first and second power supplies are of the AC type.

13. The apparatus of claim 11 wherein the first and second power cables supply DC power and wherein the first and second power supplies are of the DC type.

14. The apparatus of claim 11 wherein the first power cable supplies AC power and the second power cable supplies DC power and wherein the first and second power supplies are of the AC type.

15. The apparatus of claim 11 wherein the first power cable supplies AC power and the second power cable supplies DC power and wherein the first and second power supplies are of the DC type.

16. The apparatus of claim 11 wherein the first power cable supplies AC power and the second power cable supplies DC power and wherein the first power supply is of the DC type and the second power supply is of the AC type.

* * * * *